United States Patent [19]

Gardner

[11] 4,165,784

[45] Aug. 28, 1979

[54] CASING PERFORATOR

[76] Inventor: Benjamin R. Gardner, 4642 Idlewild Rd., Salt Lake City, Utah 84117

[21] Appl. No.: 836,372

[22] Filed: Sep. 26, 1977

[51] Int. Cl.[2] ..... E21B 43/112

[52] U.S. Cl. ..... 166/55.3; 166/298; 166/117.5; 175/267; 30/104

[58] Field of Search ..... 166/55.1, 55.2, 55.3, 166/55.7, 55.8, 117.5, 298; 175/267-269, 234, 241, 61, 77, 78; 30/104, 108; 92/121; 415/216; 239/239-242

[56] References Cited

U.S. PATENT DOCUMENTS

| | | | |
|---|---|---|---|
| 537,087 | 4/1895 | Travis | 239/242 |
| 946,204 | 1/1910 | Damon | 30/104 |
| 1,417,331 | 5/1922 | Keller | 166/55.2 |
| 1,779,652 | 10/1930 | Wood | 166/55.3 |
| 1,874,880 | 8/1932 | Brotherton et al. | 166/55.8 |
| 3,382,938 | 5/1968 | Williams, Jr. | 175/61 X |

*Primary Examiner*—Ernest R. Purser

*Assistant Examiner*—Nick A. Nichols, Jr.

*Attorney, Agent, or Firm*—M. Reid Russell

[57] ABSTRACT

The present invention involves a tool for connection to a conventional drill string and operation therewith for punching holes in a standard casing located within a well bore to pass water or gas therethrough for recovery at the well bore surface, the invention involving a pivotally arranged blade that can be extended by air, water, or mud that has passed through the drill string to impinge on a trigger end of that blade, a point end thereof engaging the casing wall whereafter, by forcing the drill string and tool downwardly, the blade pointed end will puncture the casing, removal of the blade from the casing wall involving only ceasing passing of air or fluid against the blade trigger and lifting of the drill string and connected tool. The tool also involves a backup arrangement for connection to the tool body to increase the diameter thereof to allow the tool to be used in a number of different sizes of casings.

3 Claims, 4 Drawing Figures

CASING PERFORATOR

BRIEF DESCRIPTION OF THE INVENTION

1. Field of the Invention

This invention relates to improved tools for perforating or forming holes in a conventional well bore casing.

2. Prior Art

Devices for repeatedly piercing a well bore casing wall have long been known and in common use, such devices being useful to increase the flow through that casing to increase well capacity. Examples of two different devices, each arranged to repeatedly puncture well casing walls that are mechanically operated are shown in U.S. Pat. Nos. 1,874,880 and 2,328,782. These devices, like the present invention, are attachable to a conventional drill string to form holes in a well casing wall but, unlike the present invention, involve spring-operated blade portions to form such holes. Unlike these earlier devices, blade movement of the present invention occurs when an appropriate flow of air or fluid is directed against a cupped trigger portion secured to that blade, the blade pivoting such that the blade pointed end is forced into engagement with the casing wall.

Similar to the present invention, a U.S. Pat. No. 1,417,331, by J. E. Keller, involves a tool for attachment to a conventional drill string to receive air or liquid and therein, directs it against a trigger end of a blade to force a pointed end of that blade into contact with a casing wall whereafter, the tool can be appropriately lowered to force that blade pointed end through the casing wall. While the Keller tool is similar to the device of the present invention, it does not provide for the cupped trigger arrangement of the present invention for insuring a positive pivotal movement of the blade attached thereto, nor does the Keller tool provide for the addition of a backup to the tool body such that the tool can be used in different diameters of casings by addition or deletion of that backup to the tool body.

The present invention is, therefore, significantly different from the discovered and above-cited prior art devices and, further, is unlike any device within the knowledge of the inventor and, so, is believed to be both novel and unique.

SUMMARY OF THE INVENTION

It is the principal object of the present invention to provide a casing perforator tool for connection to the end of a conventional drill string for arrangement within a well casing, at any desired depth, whereat it can be air or fluid operated from the surface to perforate, as desired, the casing wall.

Another object of the present invention is to provide a casing perforator tool for connection to a conventional drill string arranged to receive air or fluid passed therethrough, the tool involving air or fluid-operated trigger means connected to a pivoting blade portion, the air or fluid rotating that blade portion such that a pointed end thereof will engage a casing wall for puncturing or perforating that casing wall when the drill string and connected tool are lowered, with removal of that tool from the casing wall requiring only discontinuing the air or fluid and lifting of the tool, the blade pointed end passing out of the hole it has formed, the blade pivoting into the tool body whereafter the process can be repeated.

Still another object of the present invention is to provide a casing perforator tool for installation on the end of a conventional drill string, the body of which tool is arranged to have attached thereto a backup for increasing the tool body cross section allowing the tool to be used in a number of different diameter well casings for repeatedly perforating that well casing at a desired depth.

Still another object of the present invention is to provide a casing perforator tool that is simple to construct from standard materials used in manufacturing well drilling tools, the present invention involving a minimum of moving parts and so will provide reliable serve at minimal cost.

The principle features of the present invention in a casing perforator tool include a tool body that is preferably formed to have a diameter that is somewhat smaller than the smallest diameter of casing in which the tool could be utilized. A backup is arranged for releasable attachment to that body for increasing the diameter of the tool so that it can be utilized, as needed, in larger diameter casings; the tool body also having bumpers arranged therewith for spacing a slot opening in the tool body, wherein the blade portion thereof is pivoted, away from the casing wall for allowing proper operation of that blade portion.

The casing perforator tool of the present invention is preferably connected to a conventional drill string by a threaded neck portion thereof turned into a collar end of the drill string such that it can be lowered on the end of that drill string into a well casing to a depth whereat casing perforation is desired. The tool is intended to receive a burst of air or fluid from the drill string to which it is attached, channeling that air or fluid so that it impinges upon a cupped trigger portion that is arranged on an end of a blade that is pivotally coupled within the tool body slot opening; the cupped trigger is thereby moved downwardly under the impetus or impact of that air or fluid, elevating a pointed end of that blade into the casing wall. Whereafter, to puncture the casing wall at that point, the drill string and connected tool are forced downwardly, the pointed end of the tool blade thereby being fully pivoted into an extended attitude, normal to the tool body, that pointed end piercing the casing. Removal of the tool blade requires only ceasing of the air or fluid flow and lifting of the tool to rotate the blade around its pivot, the pointed end thereof passing out of the hole it has just formed and into the tool body whereafter, the tool can be pivoted by turning the drill string and the process repeated. The casing perforator tool of the present invention can, therefore, be used to make any desired number of perforations or holes in a casing wall, at any desired depth, utilizing only minimum amounts of air or fluid passed therethrough to trigger the blade portion thereof to function as described above.

Further objects and features of the present invention will become apparent from the following detailed description taken together with the accompanying drawings.

DRAWINGS

FIG. 1 is a profile perspective view of the casing perforator tool of the present invention shown removed from the end of a conventional drill string, having a pointed end portion of a blade thereof shown extending outwardly from the side thereof;

FIG. 2, a top plan view of the casing perforator tool of FIG. 1 showing portions of the body and backup thereof removed to expose a connection arrangement for joining that backup to the tool body;

FIG. 3, a sectional view of the casing perforator tool taken along the line 3—3 of FIG. 1, the tool shown installed in a section of conventional well casing, a blade portion thereof shown in broken lines in its relaxed attitude within the tool body and in solid lines in its extended attitude, showing a pointed end thereof puncturing the well casing wall, the view also showing the interior of the tool body; and FIG. 4, a profile sectional view of the blade of FIG. 3 shown as including a trigger cup arrangement arranged to receive air, fluid or the like striking thereon, the force of that fluid causing the blade to pivot to the attitude shown in FIG. 3.

DETAILED DESCRIPTION

Figure 1:
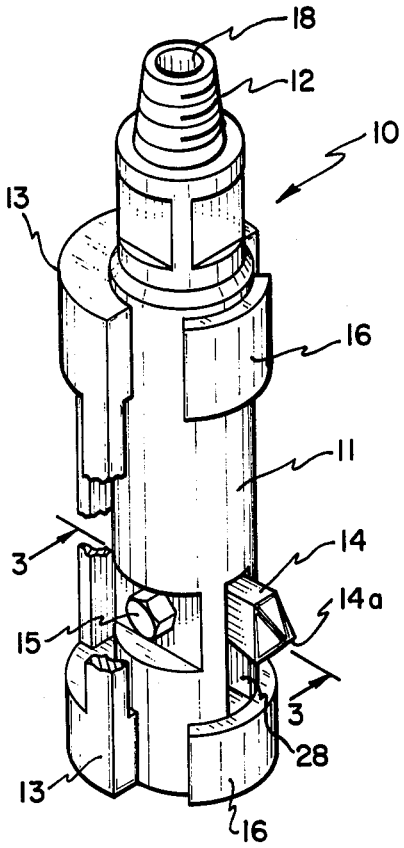
Figure 3:
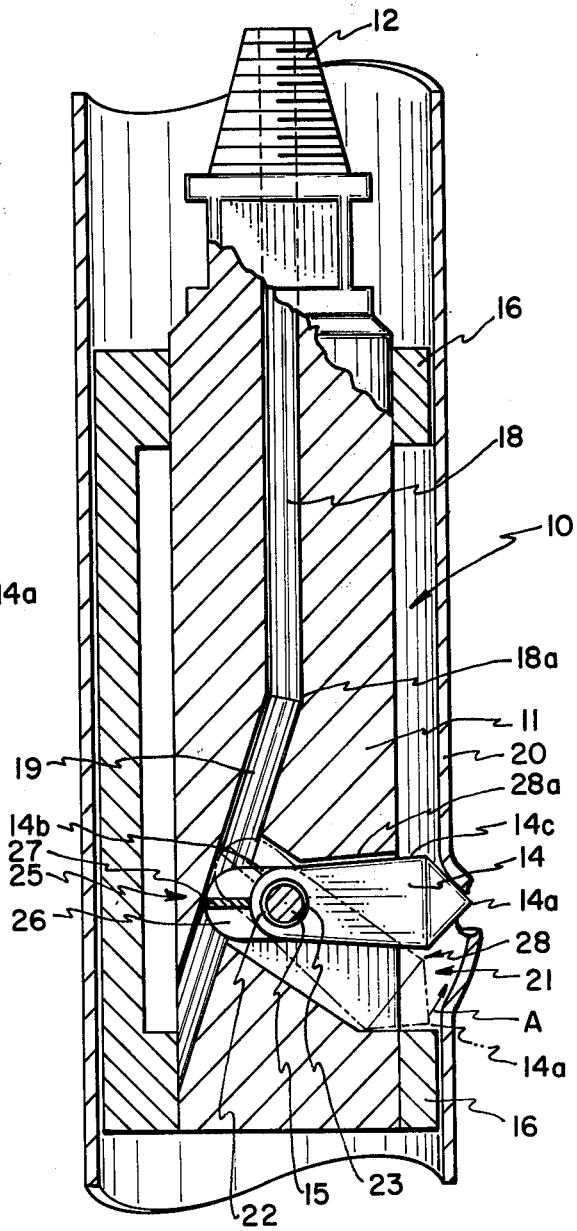

Referring now to the drawings:

In FIG. 1 is shown a profile perspective view of a preferred embodiment of the casing perforator tool 10 of the present invention, hereinafter referred to as "tool". As shown therein, tool 10 incorporates a cylindrical body 11 that has a threaded neck 12 arranged on one end thereof and has also a backup 13 arranged therewith that can be attached to or detached therefrom, at will, whose function will be explained in detail later herein. Pivotally arranged in the tool body 11 in a slot opening 28 formed therein, that is shown best in FIG. 3, is a blade 14, shown in solid lines in FIG. 3 in an extended attitude. A pointed end **14*a* thereof is shown extending normal to tool body 11, that blade end 14*a* puncturing a hole 21 in a casing wall 20, with the point thereof shown preferably equidistant from the blade sides and top and bottom thereof. A bolt 15 is fitted through body 11, passing through slot opening 28, a bushing 22 arranged in the side of blade 14, and is turned into a taphole, or has an appropriate nut turned thereover, not shown, to maintain blade 14** in its pivotal arrangement.

Shown also in FIG. 1, tool body 11 incorporates bumpers 16 arranged around sections of the top and bottom ends thereof for spacing blade 14 sufficiently apart from the wall of casing 20 such that, as will be described later herein, when blade 14 is rotated, the pointed end **14*a* will be pivoted sufficiently to engage the casing wall, as shown best in FIG. 3. Thereafter, by lowering tool 10 as by forcing the drill string connected thereto, not shown, downwardly, the blade pointed end 14*a* will be driven into casing wall, puncturing that wall as shown in FIG. 3. Without bumpers 16 spacing apart the tool body 11 from the casing wall, the blade pointed end 14*a*, when rotated appropriately, would possibly not bind therein, possibly slipping therealong when the tool 10** is moved downwardly.

Figure 2:
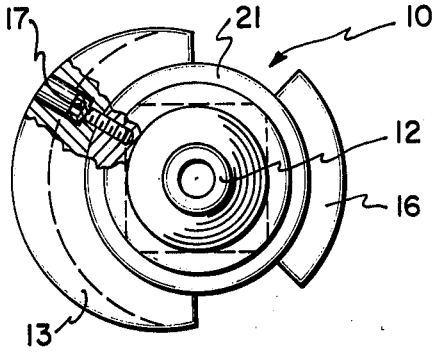
Figure 4:
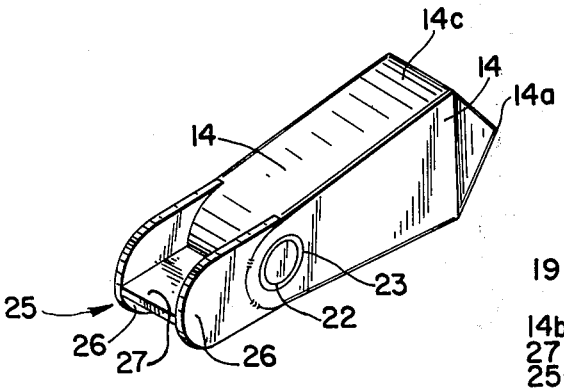

Shown in FIG. 2, tool 10, as was mentioned hereinabove, incorporates a backup 13 thereto that should be understood is for enlarging the cross section of the tool body 11 such that the tool 10 can be used in a casing 20 significantly larger in diameter than is the tool body 11 alone. Backup 13, as shown in FIG. 2, is preferably releasably attached by screws 17, or the like, to tool body 11. Backup 13 could, of course, be any desired size that is appropriate to increasing the cross section of tool body 11 for installation in a particular size of casing.

Shown best in the sectional view of FIG. 3, the tool body 11 has a longitudinal passageway 18 formed therein that passes through the top of threaded neck 12, progressing longitudinally into the tool interior to a bend **18*a* where it intersects an aslant passage 19, the aslant passage 19 continues therefrom through the tool body exiting the bottom thereof. Longitudinal passage 18 and aslant passage 19 will pass air or fluid therethrough for appropriately impacting upon a trigger 27 portion of a cup 25 that is secured to end 14*b* of blade 14 and extends outwardly therefrom, the air or fluid striking trigger 27 rotates the blade on a bushing 22. The bushing 22 is fitted within a hole 23 formed through the side of blade 14, through which bushing bolt 15** is fitted the blade pivoting as shown by arrow A in FIG. 3.

In the sectional view of FIG. 3, blade 14 is shown in solid lines in its extended attitude, which blade attitude is also that shown in FIG. 1, with the blade shown in broken lines in FIg. 3 in relaxed state where the pointed end **14*a* thereof is within a line drawn between bumpers 16 not in contact with the casing wall 20**.

To facilitate the above-described pivotal movement of blade 14, as shown by the arrow A in FIG. 3, the cup 25 is arranged across the end **14*b* of blade 14 and consists of parallel walls 26 that extend outwardly from the end 14*b* of blade 14, each in the plane of a side thereof, the trigger 27 extending therebetween. As shown in FIG. 3, parallel walls 26 are arranged in the plane of the aslant passage 19 and the trigger 27 is arranged to extend across that passage such that air or fluid passing therealong will strike and be maintained against that trigger, moving the trigger downwardly to rotate the blade 14 to that attitude shown by the solid lines in FIG. 3. When no air or fluid is passed through longitudinal passage 18 and aslant passage 19, the unbalanced weight of the blade 14 around its pivot and bolt 15 is such that it will pivot to the attitude shown by broken lines in FIG. 3, in which attitude pointed end 14*a* thereof is within the line of the bumpers 16**.

Operation of tool 10, therefore, involves only passage of air or fluid, as through a drill string, to which drill string tool 10 is connected, not shown, this air or fluid passing then through longitudinal passage 18 past bend **18*a* therein and into aslant passage 19 wherein it strikes trigger 27. Trigger 27 pivots the blade 14 such that the pointed end 14*a* thereof is moved against the casing wall 20, whereafter, by forcing tool 10 downwardly, blade 14 is rotated to its fully extended attitude as shown in FIG. 3, the pointed end 14*a* passing through casing wall 20 and a blade top surface 14*c* contacting a top wall 28*a* of slot opening 28. Air or fluid passing around trigger 27 of cup 25 can proceed down through the aslant passage 19, exiting the bottom of tool 10, or it can pass around blade 14 and out of the tool along the body 11 thereof. Of course, the flow of air or fluid is discontinued after hole 21 is formed. Thereafter, removal of the blade pointed end 14*a* from the casing wall 20 involves only lifting of the tool, as by appropriate lifting of the drill string, not shown, pivoting thereby the blade 14 downwardly, the blade pointed end 14*a* passing out from hole 21. With the blade end 14*a* freed, the blade will rotate in slot opening 28 such that point end 14*a* thereof comes to rest within a line drawn between the bumpers 16 away from the casing wall. Thereafter, the tool can be repositioned as by turning the drill string, not shown, and the process repeated to punch or form another hole 21 in the casing wall 20**.

While a preferred blade 14 has been shown herein as involving a pointed end thereof that is centered so as to be equidistant from the top, bottom and sides thereof, it should be obvious that other blade configurations could be employed, with such other configurations being for forming different sizes or shapes of hole in casing wall 20, which blade alteration should be understood to still come within the subject matter coming within the scope of this disclosure. Also, while the preferred arrangement of cup 25 is that shown as consisting of parallel walls 26 arranged between trigger 27, it should be obvious that other cup configurations could be utilized without departing from the subject matter coming within the scope of this disclosure. Further, depending upon whether passage of air or liquid through longitudinal opening 18 and aslant opening 19 is against a pressure, as say if the well bore was filled with liquid, it may be useful to seal the area of cup 25 to maintain a pressure differential around trigger 27 whereafter, that pressure could be released as through a valve, not shown, fitted into the aslant passage 19 below cup 25 for passing the fluid or air buildup therethrough. Likewise, appropriate seals could be included between the blade 14 and the sides of slot opening 28 wherein blade is pivotally arranged.

Though preferred embodiments of the casing perforator tool of the present invention have been shown and described herein, it should be understood that variations, changes, adaptations, modifications, and the like, may be made to the disclosed invention without departing from the subject matter coming within the scope and spirit of the following claims, which claims I regard as my invention.

I claim:

1. A casing perforator tool comprising a cylindrical housing;

means for connecting, on an end thereof, said cylindrical housing to a conventional drill string;

passage means formed through said drill string and into said cylindrical housing;

a blade pivotally connected within a slot opening in said cylindrical housing such that, when rotated appropriately, a pointed end thereof will extend beyond the plane of the cylindrical side of said cylindrical housing;

trigger means attached to said blade end opposite to said pointed end thereof, consisting of a cup arrangement formed by parallel walls that extend outwardly from and in the planes of the opposite sides of the blade with a trigger secured to and extending between said parallel walls, said trigger means intersecting said passage means for pivoting appropriately said blade;

a half cylindrical backup arranged to be releasably attached to said cylindrical housing, on the side opposite to the extension of said blade, increasing the cross section thereof; and means for attaching said half cylindrical backup to said cylindrical body.

2. A casing perforator tool as recited in claim 1, further including, bumpers connected to top and bottom ends of the cylindrical housing, said blade arranged therebetween.

3. A casing perforator tool as recited in claim 1, wherein the point of the blade pointed end is equidistant from the blade sides and top and bottom thereof.

* * * * *